US007373729B2

(12) United States Patent
Mossot et al.

(10) Patent No.: US 7,373,729 B2
(45) Date of Patent: May 20, 2008

(54) DEVICE AND METHOD FOR LAYING FLOOR COVERINGS IN CORNER AREAS WHERE FLOORS AND WALLS MEET

(75) Inventors: Yves Mossot, Tarare (FR); Patrice Farine, Violay (FR)

(73) Assignee: Gerflor, Villeurbanne (FR)

( * ) Notice: Subject to any disclaimer, the term of this patent is extended or adjusted under 35 U.S.C. 154(b) by 0 days.

(21) Appl. No.: 11/450,482

(22) Filed: Jun. 9, 2006

(65) Prior Publication Data

US 2006/0277777 A1 Dec. 14, 2006

(30) Foreign Application Priority Data

Jun. 14, 2005 (FR) ..... 05 51607

(51) Int. Cl.
*G01B 1/00* (2006.01)
*E04B 2/00* (2006.01)

(52) U.S. Cl. ..... 33/527; 33/526; 33/562; 33/563; 52/287.1

(58) Field of Classification Search ..... 33/526, 33/527, 562, 563, 565, 566, DIG. 20; 52/287.1, 52/288.1, 58
See application file for complete search history.

(56) References Cited

U.S. PATENT DOCUMENTS 56,800 A * 7/1866 Richards ..... 52/288.1
182,990 A * 10/1876 Bugbee ..... 52/287.1
396,126 A * 1/1889 White ..... 52/287.1
462,164 A * 10/1891 Rockwell ..... 52/287.1
599,395 A * 2/1898 Liebreich ..... 52/287.1
799,430 A * 9/1905 Anderson ..... 52/287.1
922,146 A * 5/1909 Jennison ..... 52/287.1
1,845,603 A * 2/1932 Huntley ..... 52/288.1
2,279,755 A * 4/1942 Lemen et al. ..... 52/288.1
2,776,493 A * 1/1957 Jerand ..... 33/542
2,795,854 A * 6/1957 Perkal ..... 33/527
3,222,792 A * 12/1965 Eshom ..... 33/526
3,325,953 A * 6/1967 Alleaume ..... 52/276
4,114,346 A * 9/1978 Kelly ..... 52/746.1
4,330,581 A * 5/1982 Borgert et al. ..... 428/66.4
4,603,517 A * 8/1986 Lyons, Jr. ..... 52/60
4,700,512 A * 10/1987 Laska ..... 52/58
4,872,296 A * 10/1989 Janni ..... 52/58

(Continued)

FOREIGN PATENT DOCUMENTS

DE 91 13 934.1 11/1991

(Continued)

*Primary Examiner*—G. Bradley Bennett
*Assistant Examiner*—Amy Cohen Johnson
(74) *Attorney, Agent, or Firm*—Heslin Rothenberg Farley & Mesiti P.C.

(57) ABSTRACT

A device for laying floor and wall coverings in reentrant corners comprises an independent insert obtained from the same material as the flooring and having two dimensions before laying and being defined in three dimensions after laying and having, when flat, a geometrical configuration of irregular lines so that, after laying, said insert has a regular parallelepiped geometrical configuration. The insert includes, three triangular areas, of which two of the bases are part of the peripheral outline of the insert and the third inner base makes it possible, by consecutive juxtaposition, to obtain a central triangular part sloping, after laying, and situated in a forward plane away from the corner part where the successive walls and the floor meet.

9 Claims, 3 Drawing Sheets

U.S. PATENT DOCUMENTS

| | | | | |
|---|---|---|---|---|
| 5,092,090 | A * | 3/1992 | Stump | 52/287.1 |
| 5,283,997 | A * | 2/1994 | Lackie | 52/287.1 |
| 6,070,370 | A * | 6/2000 | Locke | 52/58 |
| 6,199,326 | B1 * | 3/2001 | Mayle | 52/58 |
| 2003/0159382 | A1 * | 8/2003 | Pinto | 52/300 |
| 2007/0175133 | A1 * | 8/2007 | Woytowich et al. | 52/287.1 |

FOREIGN PATENT DOCUMENTS

| | | |
|---|---|---|
| DE | 295 06 296.7 | 4/1995 |
| EP | 0437660 | 7/1991 |
| WO | WO91/10792 | 7/1991 |
| WO | WO91/10554 | 9/1991 |

* cited by examiner

DEVICE AND METHOD FOR LAYING FLOOR COVERINGS IN CORNER AREAS WHERE FLOORS AND WALLS MEET

BACKGROUND OF THE INVENTION

The invention relates to the technical field of floor and wall coverings that use polyvinyl chloride or similar materials.

The Applicant is a European leader in the manufacture of this type of floor and wall covering and is aware that laying such coverings in reentrant corners is performed by running them up like a skirting board.

A first method which is currently widely used involves the following phases. This process is illustrated in FIGS. 1 and 2. A quadrant-shaped piece (1) which is fixed by bonding or otherwise its longitudinal end parts to the opposite facing parts of the floor and walls is placed along the joining line between the floor and the walls. Then, the floor covering is offered up into the corner area by allowing it to run up into contact with the corresponding vertical surfaces of the wall. This involves previously cutting the floor covering along a line (2) at 45°, the end part of which corresponds to the bottom part of the joint with the 45° line extending up as far as the upper longitudinal end of the floor covering. Forming the corner in the two successive vertical planes creates a fold due to the excess material and, in order to avoid excess thickness, the excess pieces of material must be cut away on a trial-and-error basis. This operation is performed in situ and is far from practical. The floor covering must then be bonded into the reentrant corner and the opposite edges either side of the 45° line must be welded. This removal of excess material is necessary in order to prevent excess thicknesses in the area in question. The difficulty involved is real and demands considerable expertise on the part of the operative because cutting the floor covering in order to eliminate excess thickness is far from easy to achieve. This hot welding by depositing a weld bead (3) starts from the extreme reentrant point along the oblique line. One of the difficulties encountered is to master the quality of welding which can only be checked visually. In practice, it has been found that if there is even the slightest initial cracking, sealing will not be achieved.

Another problem is the fact that the welding operation in corners using a roller or nozzle may cause damage to the floor covering in the corner such as, for instance, burns on the floor covering and geometrical deformation, bulges etc. and an untidy visual appearance.

This solution is widely used given the lack of satisfactory alternate solutions and has yet another drawback. The corner parts can be considered as dust traps and facilitate the accumulation of dust and dirt of all kinds and are therefore areas that are particularly prone to soiling. However, floor and wall coverings of the type described are widely used on public and private premises where hygiene is an absolute must. This applies in the case of hospitals for example. The manual or mechanised means of cleaning and cleaning tools used of the brush and broom type do not make it possible to ensure thorough cleaning because it is not possible to access the extreme part of the corner.

It is therefore apparent that this solution is relatively impractical and has many disadvantages.

The Applicant's approach, around fifteen years ago, was to suggest a different solution based on separately fitted thermoformed corner components shown in FIG. 3. This solution which initially seemed attractive turned out to be relatively impractical in use and was abandoned in favour of the old method. This second solution involved producing corner components (4) made of plastic with predefined finished shapes that fit perfectly into the corner area and bonding them to the opposite facing parts of the floor and the walls. In fact, management and the necessary logistics to manufacture and install them remained onerous. The plumbness and squareness of the successive walls relative to the floor is far from perfect in practice and then becomes a problem during preliminary fitting and arrangement of these thermoformed corner components relative to the walls. In addition, another major drawback was the fact that there was loss of uniformity between the characteristics and decorative features of floor coverings and the corner components.

This second technology which was used by the Applicant was abandoned because it was impossible to utilise it on an industrial scale.

The Applicant therefore went back to the initial solution even though it had and still has many disadvantages.

Faced with this situation, the Applicant nevertheless continued its research in order to find other alternative solutions.

SUMMARY OF THE INVENTION

New research resulted in a solution that is highly attractive in that it makes it possible to overcome all the problems initially encountered and makes it possible to ensure that the visual appearance of the installed floor covering is homogeneous, even in corner areas.

According to the invention, the device for laying floor and wall coverings in reentrant corners is distinctive in that it consists of an independent insert made from the same material as the floor covering and having the same structural and decorative characteristics, said corner insert having two dimensions before it is laid and being defined in three dimensions after it is laid and having, when flat, a geometrical configuration of its irregular lines so that, after it is laid, a peripheral outline of said insert has a regular parallelepiped geometrical configuration and in that said insert comprises 4 areas, three triangular areas of which two of the bases are part of the peripheral outline of the insert and a third inner base makes it possible by consecutive juxtaposition to obtain a central triangular part which slopes after laying and is located in a forward plane away from the corner area where the successive walls and the floor meet, said triangular central part constituting a visible easy-to-access clearance part for cleaning and making it possible to dislodge and collect dust and other particles on its base.

According to another aspect, the method for laying floor and wall coverings in reentrant corners is distinctive in that it involves cutting out inserts in special geometrical shapes from the material of the covering intended to be laid on the floor, said cut-out inserts having two dimensions, offering up said inserts in the reentrant corner areas to be covered and deforming them in order to produce triangular flat parts intended to be fixed to the opposite-facing walls and floor and defining a central triangular sloping part with the base facing forward, this central part standing away from the corner where the walls and floor meet and in that the insert thus produced fits into a corner cut-out made in the main covering and in that the corner insert is fixed by bonding or another method to the opposite-facing walls and floor apart from its central area and in that the joint between the insert and the main covering is obtained by butt joining and depositing a means of connection.

These aspects and others will become apparent from the following description.

BRIEF DESCRIPTION OF THE DRAWING FIGURES

The object of the present invention is described, merely by way of example, in the accompanying drawings in which.

DETAILED DESCRIPTION

In order that the present invention may more readily be understood, the following description is given, merely by way of example, reference being made to the accompanying drawings.

(1A) and (1B) denote two successive walls and (1C) denotes the floor capable of being covered by a floor covering (R) based on polyvinyl chloride or other similar materials having appropriate characteristics depending on the needs of the application. The reentrant corner area is denoted as (1D) and is therefore defined as being the area where the two successive perpendicular walls meet relative to the floor plane (1C).

Figure 6:
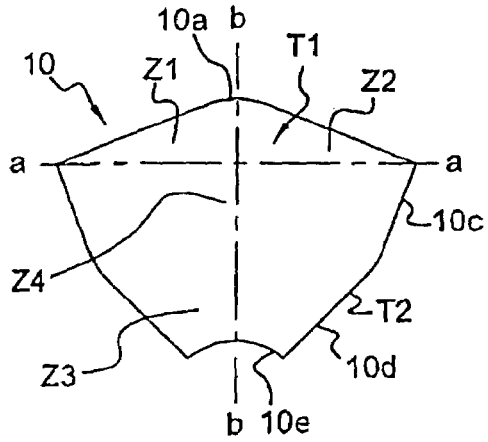
FIGS. 6, 7, 8 and 9 are views of the insert device according to the invention in four alternative embodiments.
Figure 8:
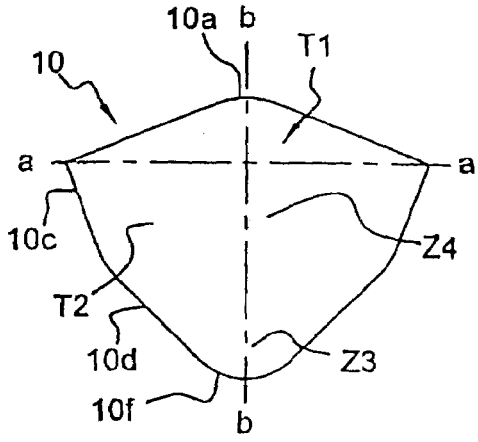
Figure 7:
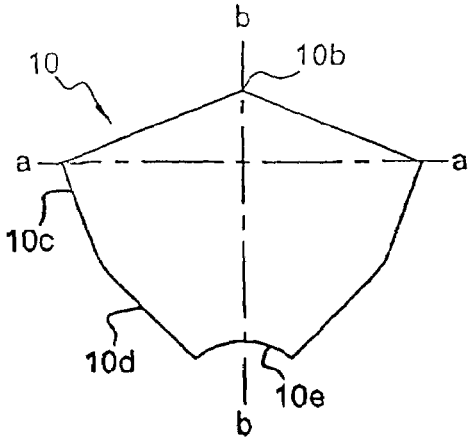
Figure 9:
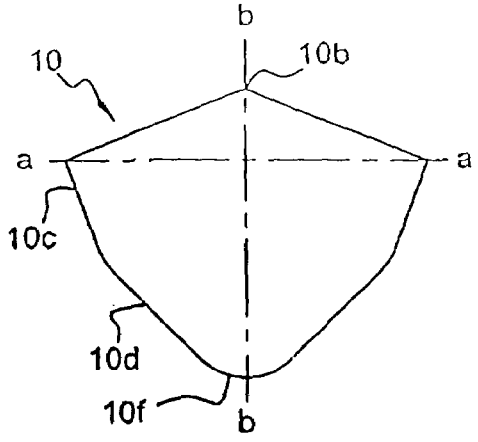

According to the invention, one places, in the corner areas of a location having a structure of any nature and for any application, independent devices consisting of corner inserts (10) that are made of the same material as the actual floor covering. Thus, the corner inserts (10) have the same technical characteristics and visual appearance as the coverings laid in the location in question, thereby ensuring absolute harmonious consistency in terms of visual appearance and continuity of the technical characteristics of the covering. Each insert (10) is therefore manufactured in the same way as the covering and initially has two dimensions in its initial state before it is laid. The covering (R) and therefore the insert(s) (10) has/have, thanks to its/their constituent material, a certain amount of flexibility and can therefore be deformed. The insert (10) according to the invention has, when flat and after being cut out, an irregular flat geometrical configuration and an overall polygonal shape with two roughly triangular parts (T1-T2) that face each other and have a different surface area separated by a straight junction line (a.a) that corresponds to the maximum width (1) of the insert and a perpendicular line (b.b) that lends the insert its symmetry. The insert (10) is shown flat in FIGS. 6, 7, 8 and 9 and has a single general shape with a few variations. Thus, in FIGS. 6 and 8, the triangular part that defines two areas (Z1-Z2) that are intended to be up against the walls has a central connecting part at the curved apex (l0*a*), whereas in FIGS. 7 and 9 the joining area is established by a sharp apex (10*b*). The triangular part (T2) that is intended to be configured, after laying, substantially as two areas (Z3 and Z4), one area (Z3) being intended to constitute the forward part of the insert to be fixed to the floor and central part (Z4) which is bounded on each of its sides by the three areas (Z1-Z2-Z3). When flat, the triangular area (T2) is defined by a variation in its width with its base narrowing towards its apex at two different angles capable of forming two successive trapezoidal sections (10*c*-10*d*) having a different surface area. The end part has, as in FIGS. 6, 8 or 7, 9, a reentrant apex part (10*e*) or protruding apex part (10*f*) depending on the application.

Figure 1:
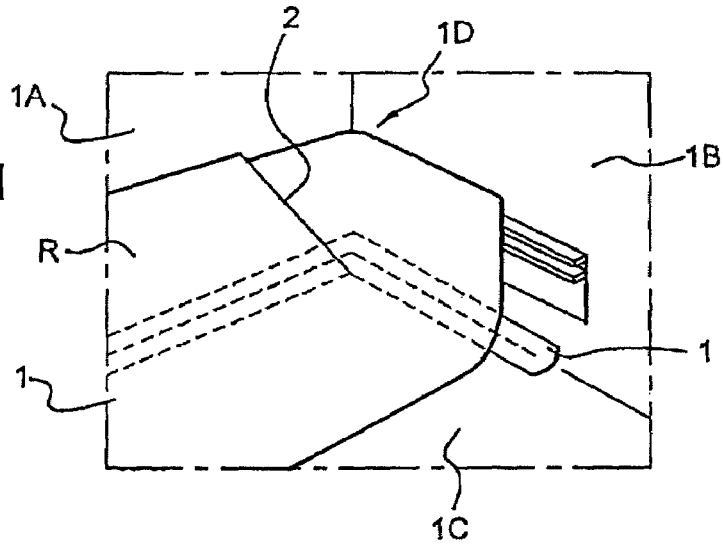
Fig. 1 Prior Art
FIGS. 1 and 2 are schematic views showing the use of reentrant corner covering parts according to the prior art and in a first embodiment.
Figure 2:
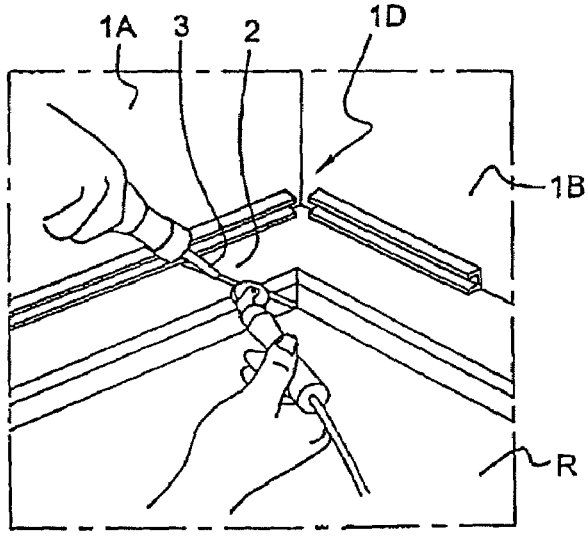
Fig. 2 Prior Art
Figure 3:
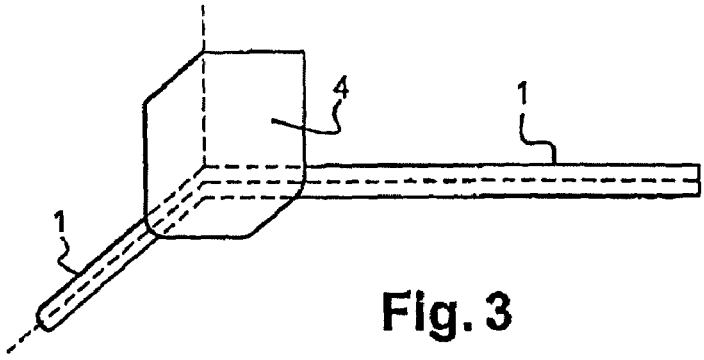
Fig. 3 Prior Art
FIG. 3 is a view of a thermoformed corner component according to the prior art.
Figure 4:
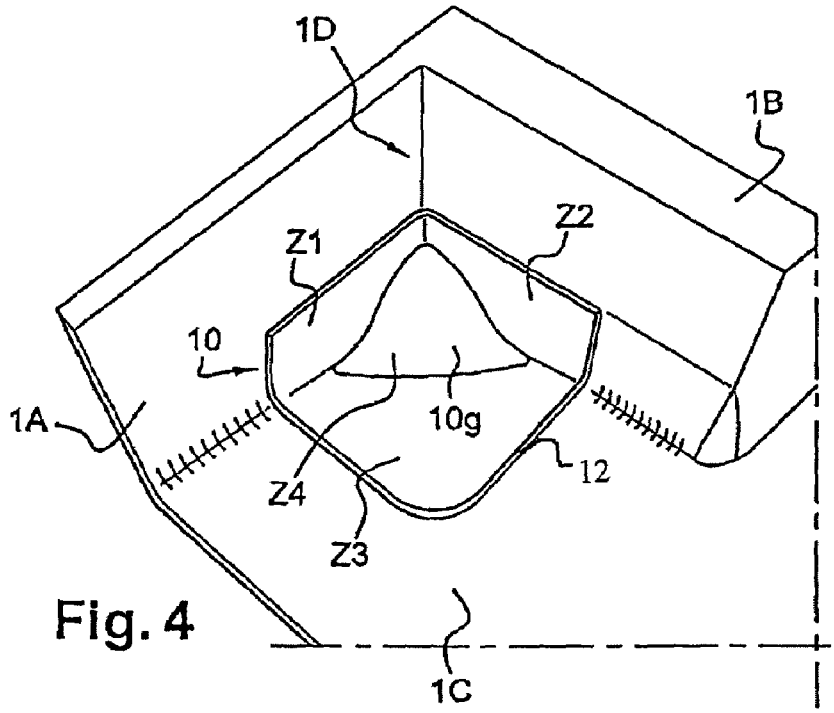
FIG. 4 is a perspective front view showing the device of a corner insert according to the invention positioned in situ and therefore represented in three dimensions.
Figure 5:
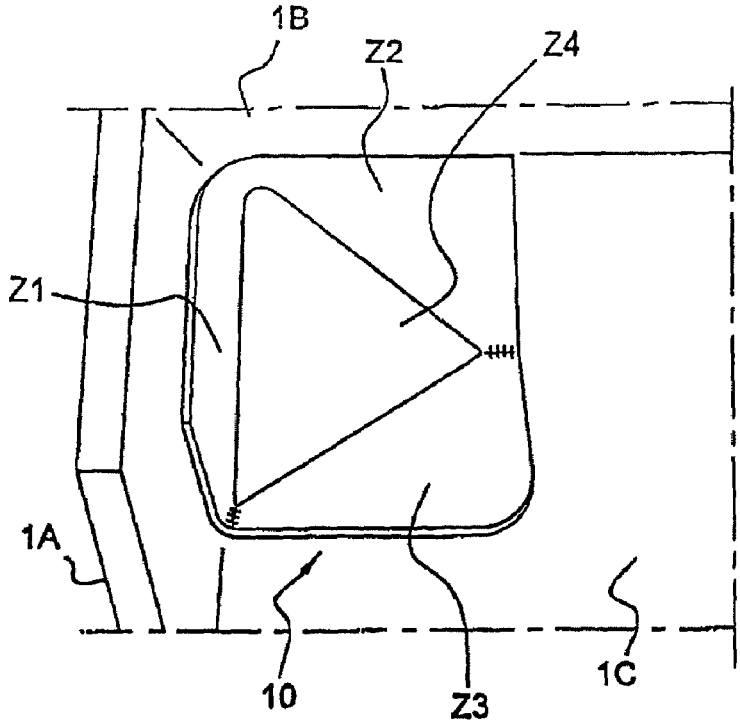
FIG. 5 is a side view according to FIG. 4.

According to the invention, the insert thus defined in its flat geometrical configuration and inherently having a certain degree of flexibility can be placed in the reentrant corner area by assuming the new configuration shown in FIGS. 4 and 5 in which a peripheral outline or border of the insert has a regular parallelepiped geometrical configuration. The insert thus comprises three triangular areas(Zl-Z2-Z3), two of which (Z1-Z2) are fixed to the opposite-facing wall and the third area (Z3) is attached forwardly to the floor by an means such as bonding or another method. The fourth area (Z4) appears by deformation and in turn has a triangular appearance and constitutes a plane (lO*g*) that slopes forward and is rigid and stands away from the reentrant corner part defined between the walls and the floor, this clearance being several centimeters depending on the dimension of the insert. This fourth area (Z4) begins substantially in the area where the triangular areas (Zl and Z2) join and extends as far as the joint with the triangular area (Z3) that is attached to the floor. The angle of slope a of this fourth area is of the order of 45° and defines a relatively large exposed clearance plane or surface while remaining continuous with the other parts of the insert and those of the floor covering associated with it. In this way one fits as many inserts as there are reentrant corners in the room or premises to be fitted out.

It should be noted that fitting the reentrant corner inserts is performed after positioning the quadrant-shaped sections initially mentioned in accordance with the prior art. The method of laying the floor coverings of inserts is as follows.

The method of laying floor and wall coverings in reentrant corners is distinctive in that it involves cutting out inserts in accordance with particular geometrical shapes from the material of the covering intended to be laid on the floor, said cut-out inserts having two dimensions, offering up said inserts in the reentrant corner areas to be covered and deforming them in order to produce flat triangular parts intended to be fixed against the opposite-facing walls and opposite-facing floor and defining a sloping central part shaped like a triangle with its base facing forward, said central part standing away from the corner in which the walls and floor meet and in that the insert produced fits into a corner cut-out made from the main covering and in that the corner insert is fixed by bonding or another method to the opposite-facing walls and floor apart from its central area and in that the joint between the insert and the main covering is obtained by butt joining and depositing a means of connection.

The advantages of the invention are readily apparent. The new concept of producing inserts from the same material and having the same decorative finish as the main floor covering and the simplicity with which the inserts can be used in situ are emphasised. They have to be deformed in three dimensions and certain parts then have to be applied against the walls and floor by joining them by bonding or another method. Cutting out, and welding in the corner are eliminated. This prevents the occurrence of damage due to the effect of heat produced by the heating tool and the tool for depositing the weld bead. This eliminates impossible-to-access corners by shifting the corner area with a large base sloping towards the front avoiding build-up of dirt. Maintenance is therefore easier and can be carried out in every location and therefore satisfies the health and safety requirements that are imposed in particular in hospital and health care environments in general.

It also meets another problem—the fact that walls and/or floors may not be perpendicular to each other, the insert, by its nature, being adaptable very easily to various geometries likely to be encountered in situ between walls/floors.

Another advantage is the possibility of the operator working with a set of templates having variable shapes and sizes which repeat the configuration of the insert according to the invention. It is sufficient for the operator to cut out the insert on site using a cutter from the length of covering made available. There will be no differences whatsoever, because the insert is cut out from the covering that is being laid.

The invention claimed is:

1. A device for laying floor and wall coverings in reentrant corners comprising an independent corner insert made of a same material as a covering and having same structural and decorative characteristics as the covering, said corner insert being flat before the insert is laid in a corner, and being deformed in situ in the corner, and being defined in three dimensions after the insert is laid in the corner and having, when flat, a geometrical configuration of irregular lines so that, after the insert is laid in the corner, a peripheral outline of said insert has a regular parallelepiped geometrical configuration, and wherein said insert comprises first and second triangular areas with bases that are part of the peripheral outline of the insert and a third triangular area with an inner base not part of the peripheral outline, wherein by consecutive juxtaposition of the first and second triangular areas flat against successive walls and the third triangular area flat against a floor of the corner, a fourth triangular central area of the insert is formed by insert deformation in situ which slopes after laying and is located in a forward plane away from a corner area where the successive walls and the floor meet, said fourth triangular central area constituting a visible easy-to-access surface for cleaning and making it possible to dislodge and collect dust and other particles on a base of said triangular central area.

2. A device as claimed in claim 1, wherein the insert has, when flat and after being cut out, an irregular flat symmetric geometrical configuration and an overall polygonal shape with two triangular parts that face each other and have a different surface area separated by a straight junction line corresponding to a maximum width of the insert and a perpendicular line that lends the insert symmetry.

3. A device as claimed in claim 2, wherein the first and second triangular areas have a central connecting part at a curved apex.

4. A device as claimed in claim 2, wherein the first and second triangular areas have a central connecting part established by a sharp apex.

5. A device as claimed in claim 2, wherein one triangular part has a configuration, after laying, forming said third area and constituting a forward part of the insert to be attached to the floor, and the central area which is bounded on each side by one of the first, second and third areas.

6. A device as claimed in claim 2, wherein, when flat, one triangular part is defined by a variation in width with narrowing of its base towards an apex at two different angles forming two successive trapezoidal sections having a different surface area, and an extreme part has a reentrant apex or protruding apex depending on the application.

7. A device as claimed in claim 1 wherein the fourth area begins substantially in a location where the first and second triangular areas are joined and extends towards a junction of the third triangular area attached to the floor, and an angle of slope $\alpha$of this fourth area is of the order of 45°and defines a relatively large exposed clearance plane or surface whilst remaining continuous with the other areas of the insert and of the covering associated with the insert.

8. A device as claimed in claim 1 wherein, when the insert is laid in the corner, a portion of the third triangular area extends from the inner base in a direction away from the corner area.

9. A method of laying floor and wall coverings in reentrant corners comprising: cutting out corner inserts in particular geometrical shapes from a material of a main covering intended to be laid on the floor, said corner inserts being initially flat, placing said inserts in the reentrant corners to be covered and deforming the inserts in situ in the corners in order to produce three triangular flat parts per insert and affixing the three triangular flat parts to respective opposite-facing walls and an opposite-facing floor, thereby defining a central sloping triangular part for each insert with a base facing forward, said central part standing away from a corner in which the walls and floor meet, and a peripheral outline of each insert in a respective corner has a regular parallelepiped geometrical configuration, and wherein each insert fits into a corner cut-out made in the main covering, and each corner insert is attached by bonding or another method to the opposite-facing walls and floor except for the central part, and a joint between each insert and the main covering is obtained by butt joining and depositing a means of connection.

* * * * *